US011280349B2

(12) United States Patent
Kanno et al.

(10) Patent No.: US 11,280,349 B2
(45) Date of Patent: Mar. 22, 2022

(54) IMPELLER AND ROTARY MACHINE

(71) Applicant: MITSUBISHI HEAVY INDUSTRIES COMPRESSOR CORPORATION, Tokyo (JP)

(72) Inventors: Toshifumi Kanno, Tokyo (JP); Nobuyori Yagi, Tokyo (JP); Akihiko Morikawa, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 59 days.

(21) Appl. No.: 16/757,552

(22) PCT Filed: Nov. 12, 2018

(86) PCT No.: PCT/JP2018/041819
§ 371 (c)(1),
(2) Date: Apr. 20, 2020

(87) PCT Pub. No.: WO2019/107132
PCT Pub. Date: Jun. 6, 2019

(65) Prior Publication Data

US 2021/0190087 A1 Jun. 24, 2021

(30) Foreign Application Priority Data

Nov. 29, 2017 (JP) ..... JP2017-229547

(51) Int. Cl.
*F04D 29/28* (2006.01)
*F04D 29/26* (2006.01)
(Continued)

(52) U.S. Cl.
CPC ..... *F04D 29/284* (2013.01); *F04D 17/10* (2013.01); *F04D 29/266* (2013.01); *F04D 29/30* (2013.01);
(Continued)

(58) Field of Classification Search
None
See application file for complete search history.

(56) References Cited

U.S. PATENT DOCUMENTS 2,392,858 A * 1/1946 McMahan ..... F04D 29/284 416/186 R
3,671,140 A 6/1972 Shank
(Continued)

FOREIGN PATENT DOCUMENTS

EP 2816236 A1 12/2014
EP 3026212 A1 6/2016
(Continued)

OTHER PUBLICATIONS

International Search Report issued in corresponding Application No. PCT/JP2018/041819, dated Jan. 22, 2019 (3 pages).
(Continued)

*Primary Examiner* — Juan G Flores
(74) *Attorney, Agent, or Firm* — Osha Bergman Watanabe & Burton LLP

(57) ABSTRACT

An impeller includes: a disk having a first disk member that has a tubular shape centered on an axis, and a second disk member that has a tubular shape centered on the axis and is arranged on a first side of the first disk member in a direction of the axis; a blade that is formed integrally with the second disk member; and a cover that forms a flow passage between the cover and the second disk member by covering the blade from an outer peripheral side. A recessed portion, which is recessed from the first side toward a second side in the direction of the axis, is formed in an annular-shape around the axis in the first disk member.

7 Claims, 6 Drawing Sheets

(51) Int. Cl.
*F04D 29/30* (2006.01)
*F04D 29/62* (2006.01)
*F04D 17/10* (2006.01)

(52) U.S. Cl.
CPC ..... *F04D 29/624* (2013.01); *F05D 2260/36* (2013.01); *F05D 2260/941* (2013.01)

(56) References Cited

U.S. PATENT DOCUMENTS

| | | | | |
|---|---|---|---|---|
| 4,183,719 | A * | 1/1980 | Bozung | F01D 5/045 415/143 |
| 6,033,185 | A | 3/2000 | Lammas et al. | |
| 6,183,202 | B1 | 2/2001 | Ganshaw | |
| 9,803,654 | B2 * | 10/2017 | Yagi | F01D 5/04 |
| 2006/0222499 | A1 | 10/2006 | Warikoo et al. | |
| 2013/0084188 | A1 | 4/2013 | Nagano et al. | |
| 2014/0356179 | A1 | 12/2014 | Yagi et al. | |
| 2016/0138408 | A1 | 5/2016 | Bordne et al. | |
| 2016/0290354 | A1 | 10/2016 | Yagi et al. | |
| 2019/0376391 | A1 | 12/2019 | Yagi et al. | |

FOREIGN PATENT DOCUMENTS

| | | | | |
|---|---|---|---|---|
| JP | S52-137702 | A | | 11/1977 |
| JP | 11324986 | A | * | 11/1999 |
| JP | H11-324986 | A | | 11/1999 |
| JP | 2000-154702 | A | | 6/2000 |
| JP | 2000-337294 | A | | 12/2000 |
| JP | 2013-164054 | A | | 8/2013 |
| JP | 5538337 | B2 | | 7/2014 |
| JP | 2015-101967 | A | | 6/2015 |
| JP | 2016-104980 | A | | 6/2016 |
| WO | 2018/150576 | A1 | | 8/2018 |

OTHER PUBLICATIONS

Written Opinion issued in corresponding Application No. PCT/JP2018/041819 dated Jan. 22, 2019 (14 pages).

* cited by examiner

IMPELLER AND ROTARY MACHINE

TECHNICAL FIELD

The present invention relates to an impeller and a rotary machine.

Priority is claimed on Japanese Patent Application No. 2017-229547, filed Nov. 29, 2017, the content of which is incorporated herein by reference.

BACKGROUND ART

For example, rotary machines used form industrial compressors, turbo refrigerators, and small gas turbines include an impeller in which a plurality of blades are attached to a disk fixed to a rotating body (rotor), a casing that covers the impeller from an outer peripheral side. As the impeller rotates within the casing, pressure and speed can be added to a working fluid flowing through a flow passage formed between the casing and the impeller. As one type of such an impeller, a form referred to as called a closed impeller is known. The closed impeller includes the above-described disk and blades, and a funnel-shaped cover that covers the blades from the outer peripheral side.

In manufacturing the closed impeller, a method of performing cutting work on a body before machining has been mainly used. However, in this method, it is necessary to form an impeller flow passage in a narrow region between the cover and the disk. Therefore, it is difficult to handle a tool, which may lead to a decrease in machining accuracy. Thus, in recent years, a configuration in which a disk is split into two in the axial direction has been proposed. In this configuration, each of the split disk halves is provided with a recessed portion and an insertion portion inserted into the recessed portion. The insertion portion is fixed to the recessed portion by shrink fitting or the like.

Here, at a contact portion (particularly at an angular portion of the member) between the insertion portion and the recessed portion, fretting fatigue is likely to occur due to wear as well as stress concentration is likely to occur. For this reason, there is a possibility that the reliability of the impeller may decrease. As a measure for avoiding stress concentration at a contact portion between members, for example, a configuration described in the following Patent Document 1 is known. Patent Document 1 describes a configuration in which a stress relief groove is formed in a dovetail portion of a moving blade of a rotary machine.

CITATION LIST

Patent Literature

Patent Document 1

Japanese Patent No. 5538337

SUMMARY OF INVENTION

Technical Problem

However, the stress relief groove described in Patent Document 1 is intended to be applied to the moving blade of the rotary machine, and it is difficult to apply the stress relief groove to the impeller immediately. Particularly, in the moving blade, an implant groove provided in the disk and a blade root are fitted to each other. In contrast, in the impeller, a cylindrical member in which a plurality of blades are integrated with the cover and a half disk is fitted to the other half disk. As a result, the fitting form is completely different.

For this reason, simply applying the stress relief groove described in Patent Document 1 to the impeller is not always the best. That is, a highly reliable impeller with suppressed stress concentration and fretting fatigue is still desired.

The present invention provides highly reliable impeller and rotary machine.

Solution to Problem

According to the first aspect of the present invention, an impeller includes a disk having a first disk member that has a tubular shape centered on an axis, and a second disk member that has a tubular shape centered on the axis and is arranged on a first side of the first disk member in a direction of the axis; a blade that is formed integrally with the second disk member; and a cover that forms is a flow passage between the cover and the second disk member by covering the blade from an outer peripheral side. A recessed portion, which is recessed from the first side toward a second side in the direction of the axis around the axis, is formed in an annular-shape around the axis in the first disk member. The second disk member has a second disk member body formed in a disk-shape around the axis, and an insertion portion that protrudes from the second disk member body toward the second side in the direction of the axis around the axis and is inserted into the recessed portion. A first groove, which surrounds, from the outside, a first angular portion formed by an insertion portion end surface of the insertion portion facing the second side in the direction of the axis and an insertion portion outer peripheral surface of the insertion portion facing radially outward with respect to the axis, recedes toward the second side in the direction of the axis from a recessed portion bottom surface, and recedes radially outward with respect to the axis from a recessed portion inner peripheral surface, is formed at a connection portion between the recessed portion bottom surface facing the first side in the direction of the axis and the recessed portion inner peripheral surface facing radially inward with respect to the direction of the axis in the recessed portion. A second groove, which surrounds, from the outside, a second angular portion formed by the recessed portion inner peripheral surface and a first end surface of the first disk member facing the first side in the direction of the axis, recedes radially inward with respect to the axis from the insertion portion outer peripheral surface, and recedes toward the first side in the direction of the axis from a second end surface is formed at a connection portion between the insertion portion outer peripheral surface and the second end surface of the second disk member body facing the second side in the direction of the axis.

According to this configuration, the angular portion formed by the insertion portion end surface and the insertion portion outer peripheral surface is surrounded by the first groove. For that reason, in a case where a centrifugal force or a differential pressure on both sides in the direction of the axis is applied to the disk, the stress is released by the first groove. Accordingly, the stress generated at the insertion portion end surface can be relaxed as compared to a configuration in which the first groove is not provided. Moreover, the stress concentration at the angular portion formed by the insertion portion end surface and the insertion portion outer peripheral surface can be reduced. Similarly, the second angular portion formed by the recessed portion inner peripheral surface and the first end surface is surrounded by the second groove. For that reason, in a case where a centrifugal force or a differential pressure is applied to the disk, the stress is released by the second groove. Accordingly, the stress generated on the first end surface can be relaxed as compared to the configuration in which the second groove is not provided. Moreover, the stress concentration at the angular portion formed by the recessed portion inner peripheral surface and the first end surface can be reduced.

According to a second aspect of the present invention, a third groove, which is recessed from the insertion portion end surface toward the first side in the direction of the axis, may be formed in the insertion portion end surface, and a fourth groove, which is recessed from the first end surface toward the second side in the direction of the axis, may be formed in the first end surface.

According to this configuration, the third groove is formed in the insertion portion end surface. For that reason, in a case where a stress is exerted from the direction along the insertion portion end surface, the third groove s elastically deformed so as to be crushed from both sides in the radial direction with respect to the axis. That is, the rigidity of the insertion portion end surface is reduced, and the stress can be released. Moreover, the fourth groove is formed in the first end surface. For that reason, in a case where a stress is exerted from the direction along the first end surface, the fourth groove s elastically deformed so as to be crushed from both sides in the radial direction with respect to the axis. That is, the rigidity of the first end surface is reduced, and the stress can be released.

According to a third aspect of the present invention, the first groove and the second groove may be formed over an entire region in a circumferential direction with respect to the axis.

According to this configuration, the first groove and the second groove are formed over the entire region in the circumferential direction. For that reason, it is possible to release the stress evenly over the entire region in the circumferential direction. In other words, local stress concentration in the circumferential direction can be avoided.

According to a fourth aspect of the present invention, an impeller includes a disk having a first disk member that has a tubular shape centered on an axis, and a second disk member that has a tubular shape centered on the axis and is arranged on a first side with respect to the first disk member in a direction of the axis; a blade that is formed integrally with the second disk member; and a cover that forms a flow passage between the cover and the second disk member by covering the blade from an outer peripheral side. An annular recessed portion, which is recessed from a first side toward a second side in the direction of the axis, is formed in an annular-shape around the axis in the first disk member. The second disk member has a second disk member body formed in a disk-shape around the axis, and an insertion portion that protrudes from the second disk member body toward the second side in the direction of the axis around the axis and is inserted into the recessed portion. A first tapered surface broadening in a direction intersecting the axis is formed between an insertion portion end surface of the insertion portion facing the second side in the direction of the axis and an insertion portion outer peripheral surface of the insertion portion facing radially outward with respect to the axis. A first rounded portion, which gradually curves from a recessed portion bottom surface toward a recessed portion inner peripheral surface, is formed between the recessed portion bottom surface facing the first side in the direction of the axis and the recessed portion inner peripheral surface facing radially inward with respect to the direction of the axis in the recessed portion. A second tapered surface, which broadens in a direction intersecting the axis, is formed between the recessed portion inner peripheral surface and a first end surface of the first disk member facing first side in the direction of the axis. A second rounded portion, which gradually curves from the insertion portion outer peripheral surface toward a second end surface, is formed between the insertion portion outer peripheral surface and the second end surface of the second disk member body facing the second side in the direction of the axis.

According to this configuration, the first tapered surface is formed between the insertion portion end surface and the insertion portion outer peripheral surface. For that reason, in a case where a centrifugal force or a differential pressure on both sides in the direction of the axis is applied to the disk, the stress is released by the first tapered surface. Accordingly, the stress generated on the insertion portion end surface can be relaxed as compared to a configuration in which the first tapered surface is not provided.

Moreover, the first rounded portion is formed between the recessed portion bottom surface and the recessed portion inner peripheral surface. Accordingly, for example, as compared to a case where an angular portion is formed between the recessed portion bottom surface and the recessed portion inner peripheral surface, the stress concentration in the portion can be relaxed. Additionally, particularly, by providing the first tapered surface, a large curvature radius of the first rounded portion can be secured. Moreover, since the second tapered surface is formed between the recessed portion inner peripheral surface and the first end surface, in a case where a centrifugal force or a differential pressure is applied, the stress is released by the second tapered surface. Accordingly, the stress generated on the first end surface can be relaxed as compared to a configuration in which the second tapered surface is not provided. Moreover, the second rounded portion is formed between the insertion portion outer peripheral surface and the second end surface. Accordingly, for example, as compared to a case where an angular portion is formed between the insertion portion outer peripheral surface and the second end surface, the stress concentration in the portion can be relaxed. Additionally, particularly, by providing the second tapered surface, a large curvature radius of the second rounded portion can be secured.

According to a fifth aspect of the present invention, a third groove, which is recessed from the insertion portion end surface toward the first side in the direction of the axis, may be formed in the insertion portion end surface, and a fourth groove, which is recessed from the first end surface toward the second side in the direction of the axis, may be formed in the first end surface.

According to this configuration, the third groove is formed in the insertion portion end surface. For that reason, in a case where a stress is exerted from the direction along the insertion portion end surface, the third groove s elastically deformed so as to be crushed from both sides in the radial direction with respect to the axis. That is, the rigidity of the insertion portion end surface is reduced, and the stress can be released. Moreover, the fourth groove is formed in the first end surface. For that reason, in a case where a stress is exerted from the direction along the first end surface, the fourth groove s elastically deformed so as to be crushed from both sides in the radial direction with respect to the axis. That is, the rigidity of the first end surface is reduced, and the stress can be released.

According to a sixth aspect of the present invention, the first tapered surface, the second tapered surface, the first rounded portion, and the second rounded portion may be formed over an entire region in a circumferential direction with respect to the axis.

According to this configuration, the first tapered surface, the second tapered surface, the first rounded portion, and the second rounded portion are formed over the entire region in the circumferential direction. For that reason, it is possible to release the stress evenly over the entire region in the circumferential direction. In other words, local stress concentration in the circumferential direction can be avoided.

According to a seventh aspect of the present invention, an impeller includes a disk having a first disk member that has a tubular shape centered on an axis, and a second disk member that has a tubular shape centered on the axis and is arranged on a first side of the first disk member in a direction of the axis; a blade that is formed integrally with the second disk member; and a cover that forms a flow passage between the cover and the second disk member by covering the blade from an outer peripheral side. A recessed portion, which is recessed from the first side toward a second side in the direction of the axis is formed in an annular-shape around the axis in the first disk member. The second disk member has a second disk member body formed in a disk-shape around the axis, and an insertion portion that protrudes from the second disk member body toward the second side in the direction of the axis around the axis and is inserted into the recessed portion. A third groove, which is recessed from an insertion portion end surface toward the first side in the axial direction, is formed in the insertion portion end surface of the insertion portion facing the second side in the direction of the axis. A fourth groove, which is recessed from a first end surface toward the second side in the direction of the axis, is formed in the first end surface of the first disk member facing the first side in the direction of the axis.

According to this configuration, the third groove is formed in the insertion portion end surface. For that reason, in a case where a stress is exerted from the direction along the insertion portion end surface, the third groove s elastically deformed so as to be crushed from both sides in the radial direction with respect to the axis. That is, the rigidity of the insertion portion end surface is reduced, and the stress can be released. Moreover, the fourth groove is formed in the first end surface. For that reason, in a case where a stress is exerted from the direction along the first end surface, the fourth groove s elastically deformed so as to be crushed from both sides in the radial direction with respect to the axis. That is, the rigidity of the first end surface is reduced, and the stress can be released.

According to an eighth aspect of the present invention, the third groove and the fourth groove may be formed over an entire region in a circumferential direction with respect to the axis.

According to this configuration, the third groove and the fourth groove are formed over the entire region in the circumferential direction. For that reason, it is possible to release the stress evenly over the entire region in the circumferential direction. In other words, local stress concentration in the circumferential direction can be avoided.

According to a ninth aspect of the present invention, a rotary machine includes an impeller according to any one of the above first to eighth aspects, and a casing that covers the impeller from an outer peripheral side.

According to this configuration, the rotary machine including the impeller that is strong against the fretting fatigue and has high reliability can be provided.

Advantageous Effects of Invention

According to the present invention, highly reliable impeller and rotary machine can be provided.

DESCRIPTION OF EMBODIMENTS

First Embodiment

Figure 1:
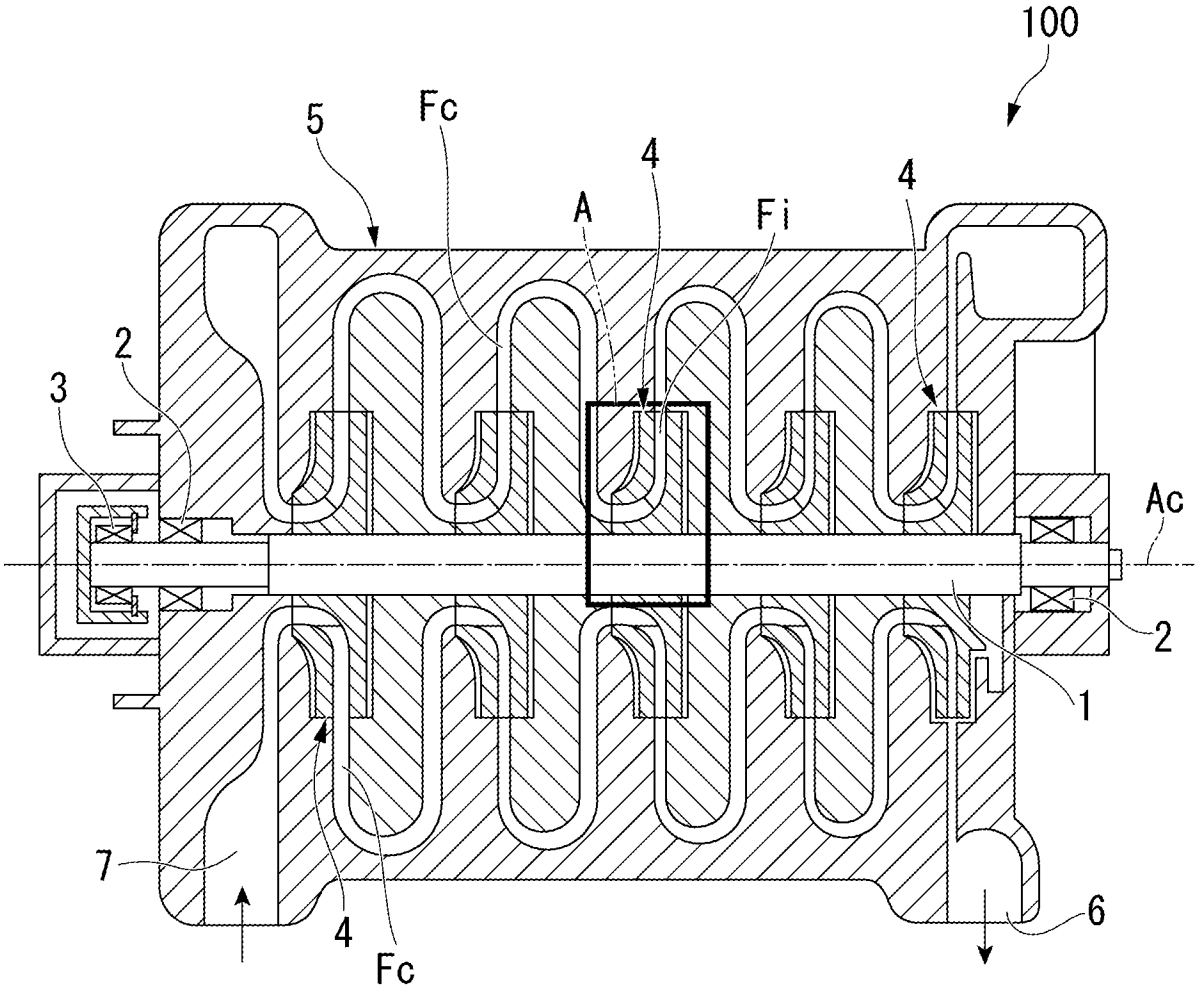
FIG. 1 is a view illustrating a configuration of a rotary machine according to a first embodiment of the present invention.

A first embodiment of the present invention will be described with reference to FIGS. 1 to 4. As illustrated in FIG. 1, a centrifugal compressor 100 (rotary machine) according to the present embodiment includes a rotor 1, a journal bearing 2, a thrust bearing 3, a plurality of impellers 4, and a casing 5.

The rotor 1 has a columnar shape centered on an axis Ac. The rotor 1 is rotated around the axis Ac by a power source (not illustrated) such as an electric motor. The plurality of impellers 4 to be described below are externally fitted to the rotor 1 at intervals in the direction of the axis Ac. That is, the impellers 4 rotate around the axis Ac integrally with the rotor 1.

A shaft end of the rotor 1 is supported by the journal bearing 2 and the thrust bearing 3 so as to be rotatable with respect to a casing 5. The journal bearing 2 supports a load acting on the rotor 1 from a radial direction with respect to the axis Ac. The journal bearings 2 are provided at both ends of the rotor 1 in the direction of the axis Ac. The thrust bearing 3 supports a load acting on the rotor 1 in the direction of the axis Ac. The thrust bearing 3 is provided only at the end of the rotor 1 on the side of a suction port 7 (to be described below).

The plurality of impellers 4 are integrally fixed to the rotor 1 and rotate integrally with the rotor 1 as the rotor 1 rotates. The plurality of impellers 4 are housed inside the casing 5 in a state where the impellers are fixed to the rotor 1. The casing 5 has a substantially tubular shape centered on the axis Ac. An exhaust port 6 is formed at one end of the casing 5 in the direction of the axis Ac, and the suction port 7 is formed at the other end of the casing 5 in the direction of the axis Ac. A casing flow passage Fc is formed between the suction port 7 and the exhaust port 6 inside the casing 5 so as to repeatedly increase and decrease in diameter along the axis Ac. A working fluid introduced into the casing 5 through the suction port 7 is compressed in the middle of passing through the casing flow passage Fc and an impeller flow passage Fi to be described below, is brought into a high-pressure state, and is discharged from the exhaust port 6 to the outside.

Figure 2:
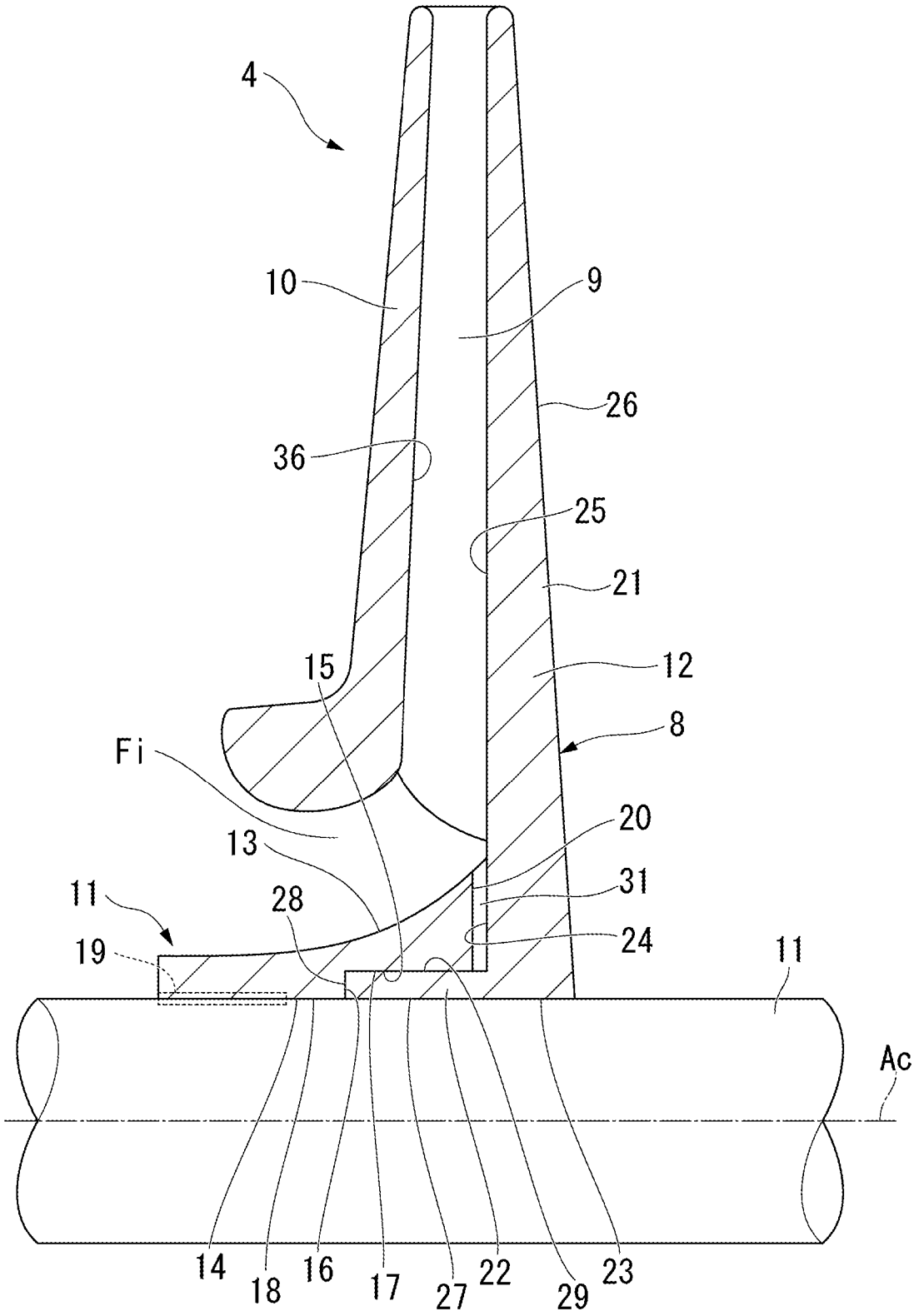
FIG. 2 is a sectional view of an impeller according to the first embodiment of the present invention.

Next, a detailed configuration of the impeller 4 according to the present embodiment will be described. FIG. 2 illustrates a region A in FIG. 1 in an enlarged manner. As illustrated in FIG. 2, the impeller 4 according to the present embodiment has a disk 8, a blade 9, and a cover 10.

The disk 8 is composed of two members. More specifically, the disk 8 has a tubular first disk member 11 centered on the axis Ac, and a disk-shaped second disk member 12 provided on a first side of the first disk member 11 in the direction of the axis Ac. An outer peripheral surface (first disk outer peripheral surface 13) of the first disk member 11 is gradually reduced in diameter from the first side toward a second side in the direction of the axis Ac. In a sectional view including the axis Ac, the first disk outer peripheral surface 13 is inclined in a gentle curved shape with respect to the axis Ac. The first disk outer peripheral surface 13 forms a part of an impeller flow passage H to be described below.

A space on the inner peripheral side of the first disk member 11 is a first insertion hole 14 into which the rotor 1 is inserted. The first insertion hole 14 has a circular section as viewed from the direction of the axis Ac, and has a constant inner diameter along the axis Ac. An annular groove (recessed portion 15) into which an insertion portion 22 (to be described below) of the second disk member 12 is inserted is formed in a portion including one end of the first insertion hole 14 in the direction of the axis Ac. The recessed portion 15 is recessed around the axis Ac from a first side toward a second side in the direction of the axis Ac. A surface, facing the first side in the direction of the axis Ac, within the recessed portion 15 is a recessed portion bottom surface 16. A surface of the recessed portion 15 facing radially inward with respect to the axis Ac is a recessed portion inner peripheral surface 17. The recessed portion bottom surface 16 has an annular shape centered on the axis Ac. The recessed portion inner peripheral surface 17 has a tubular shape centered on the axis Ac. In addition, a portion (fitting portion 19) of the first insertion hole 14 except for the recessed portion 15 on an inner peripheral surface (insertion hole inner peripheral surface 18) is shrink-fitted to the outer peripheral surface of the rotor 1. A surface of the first disk member 11 facing the first side in the direction of the axis Ac is a first end surface 20.

The second disk member 12 has a disk-shaped second disk member body 21 centered on the axis Ac, and the insertion portion 22 protruding from the second disk member body 21 in the direction of the axis Ac. A second insertion hole 23 into which the rotor 1 is inserted is formed at the position of the axis Ac of the second disk member body 21. The second insertion hole 23 has a circular section as viewed from the direction of the axis Ac, and has the same inner diameter as that of the above-described first insertion hole 14. The inner diameter of the second insertion hole 23 is constant along the axis Ac. A surface of the second disk member body 21 facing the second side in the direction of the axis Ac includes a second end surface 24 located relatively on the inner peripheral side, and a main surface 25 located relatively on the outer peripheral side of the second end surface 24. The second end surface 24 faces the above-described first end surface 20 via a gap (a second gap 31 to be described below). The blade 9 is disposed on the main surface 25 and forms a part of the impeller flow passage Fi. In addition, here, the main surface 25 is a portion of the surface of the second disk member body 21 facing the second side in the direction of the axis Ac, excluding the above second end surface 24. The surface of the second disk member body 21 that faces the first side in the direction of the axis Ac (that is, a surface opposite to the main surface 25) is a back surface 26.

The insertion portion 22 has a cylindrical shape protruding from the second disk member body 21 to the second side in the direction of the axis Ac around the axis Ac. An inner peripheral surface of the insertion portion 22 (an insertion portion inner peripheral surface 27) has the same inner diameter as that of the second insertion hole 23, and both are continuous with each other. In other words, no step is formed between the insertion portion inner peripheral surface 27 and the second insertion hole 23. A surface of the insertion portion 22 facing the second side in the direction of the axis Ac is an insertion portion end surface 28. The surface of the insertion portion 22 that faces radially outward is an insertion portion outer peripheral surface 29.

Figure 3:
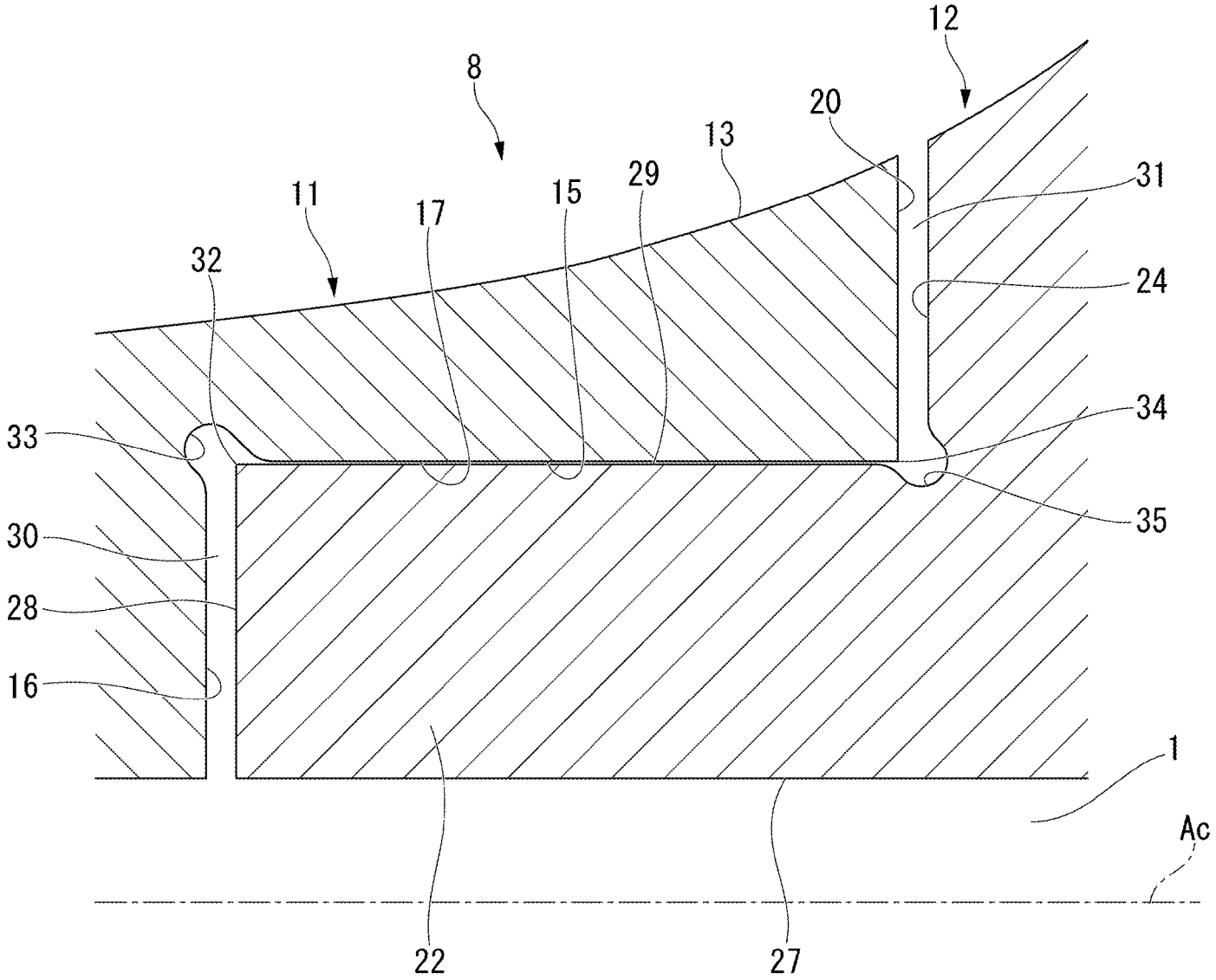
FIG. 3 is an enlarged sectional view of main parts of the impeller according to the first embodiment of the present invention.

Next, the details of a joined portion between the first disk member 11 and the second disk member 12 will be described with reference to FIG. 3. As illustrated in FIG. 3, the insertion portion end surface 28 faces the recessed portion bottom surface 16 with a gap (first gap 30) broadening in the direction of the axis Ac. The insertion portion outer peripheral surface 29 abuts against the recessed portion inner peripheral surface 17. The first end surface 20 faces the second end surface 24 with a gap (second gap 31) broadening in the direction of the axis Ac.

An angular portion formed by the insertion portion end surface 28 and the insertion portion outer peripheral surface 29 is a first angular portion 32. The first angular portion 32 is surrounded from the outside by a first groove 33 formed at a connection portion between the recessed portion bottom surface 16 and the recessed portion inner peripheral surface 17. Specifically, the first groove 33 recedes toward the second side in the direction of the axis Ac from the recessed portion bottom surface 16 and recedes radially outward from the recessed portion inner peripheral surface 17. Additionally, in a sectional view including the axis Ac, the first groove 33 has a substantially arc-shaped section. By forming such a first groove 33, the first angular portion 32 does not abut against any surface and is exposed into the first groove 33. In addition, the first groove 33 is continuously formed over the entire region in the circumferential direction with respect to the axis Ac.

The angular portion formed by the recessed portion inner peripheral surface 17 and the first end surface 20 is a second angular portion 34. The second angular portion 34 is surrounded from the outside by a second groove 35 formed at a connection portion between the insertion portion outer peripheral surface 29 and the second end surface 24. Specifically, the second groove 35 recedes radially inward from the insertion portion outer peripheral surface 29, and recedes toward a first side in the direction of the axis Ac from the second end surface 24. Additionally, in a sectional view including the axis Ac, the second groove 35 has a substantially arc-shaped section. By forming such a second groove 35, the second angular portion 34 does not abut against any surface, and is exposed into the second groove 35. In addition, the second groove 35 is continuously formed over the entire region in the circumferential direction with respect to the axis Ac.

As illustrated in FIG. 2, a plurality of the blades 9 are arranged at intervals around the axis Ac in the circumferential direction on the main surface 25 of the above-described second disk member body 21. In addition, although not illustrated in detail, each blade 9 is curved from a first side to a second side in the circumferential direction as being closer to the outside from the inside in the radial direction. A funnel-shaped cover 10 centered on the axis Ac is attached to an edge on the outer peripheral side of the blade 9. A space surrounded by the main surface 25, a pair of the circumferentially adjacent blades 9, and the inner peripheral surface of the cover 10 (cover inner peripheral surface 36) is the impeller flow passage Fi. That is, within the impeller 4, a plurality of the impeller flow passages Fi are arranged radially around the axis Ac.

Next, the operation of the rotary machine according to the present embodiment will be described. In operating the rotary machine, first, a rotating force is applied to the shaft end of the rotor 1 by the above-described electric motor (not illustrated) or the like. The plurality of impellers 4 rotate with the rotation of the rotor 1. When the impellers 4 rotate, an external working fluid (for example, air) is taken into the casing flow passage Fc from the suction port 7. The working fluid taken into the casing flow passage Fc is compressed in the course of alternately passing through the above-described impeller flow passage Fi and casing flow passage Fc, and is brought into a high-pressure state. The working fluid brought into a high-pressure state is discharged from the exhaust port 6 to the outside.

Here, a centrifugal force accompanying rotation and a pressure based on a differential pressure between the main surface 25 and the back surface 26 are added to the impellers 4 during operation. Due to such centrifugal force and pressure, stress is generated at the joined portion between the first disk member 11 and the second disk member 12. Particularly, in the vicinity of the first angular portion 32 and the above-described second angular portion 34, stress tends to concentrate, and the possibility of fretting fatigue based on the stress also occurs.

However, in the impeller 4 according to the present embodiment, as described above, the first groove 33 is formed so as to surround the first angular portion 32, and the second groove 35 is formed so as to surround the second angular portion 34. Specifically, the first angular portion 32 formed by the insertion portion end surface 28 and the insertion portion outer peripheral surface 29 is surrounded by the first groove 33. For that reason, in a case where a centrifugal force or a differential pressure on both sides in the direction of the axis Ac is applied to the disk 8, the stress is released by the first groove 33. Accordingly, the stress generated at the insertion portion end surface 28 can be relaxed as compared to a configuration in which the first groove 33 is not provided. Moreover, the stress concentration at the angular portion formed by the insertion portion end surface 28 and the insertion portion outer peripheral surface 29 can be reduced. Similarly, the second angular portion 34 formed by the recessed portion inner peripheral surface 17 and the first end surface 20 is surrounded by the second groove 35. For that reason, in a case where a centrifugal force or a differential pressure is applied to the disk 8, the stress is released by the second groove 35. Accordingly, the stress generated on the first end surface 20 can be relaxed as compared to the configuration in which the second groove 35 is not provided. Moreover, the stress concentration at the angular portion formed by the recessed portion inner peripheral surface 17 and the first end surface 20 can be reduced.

Moreover, according to the above-described configuration, the first groove 33 and the second groove 35 are formed over the entire region in the circumferential direction. For that reason, it is possible to release the stress evenly over the entire region in the circumferential direction. In other words, local stress concentration in the circumferential direction can be avoided.

Figure 4:
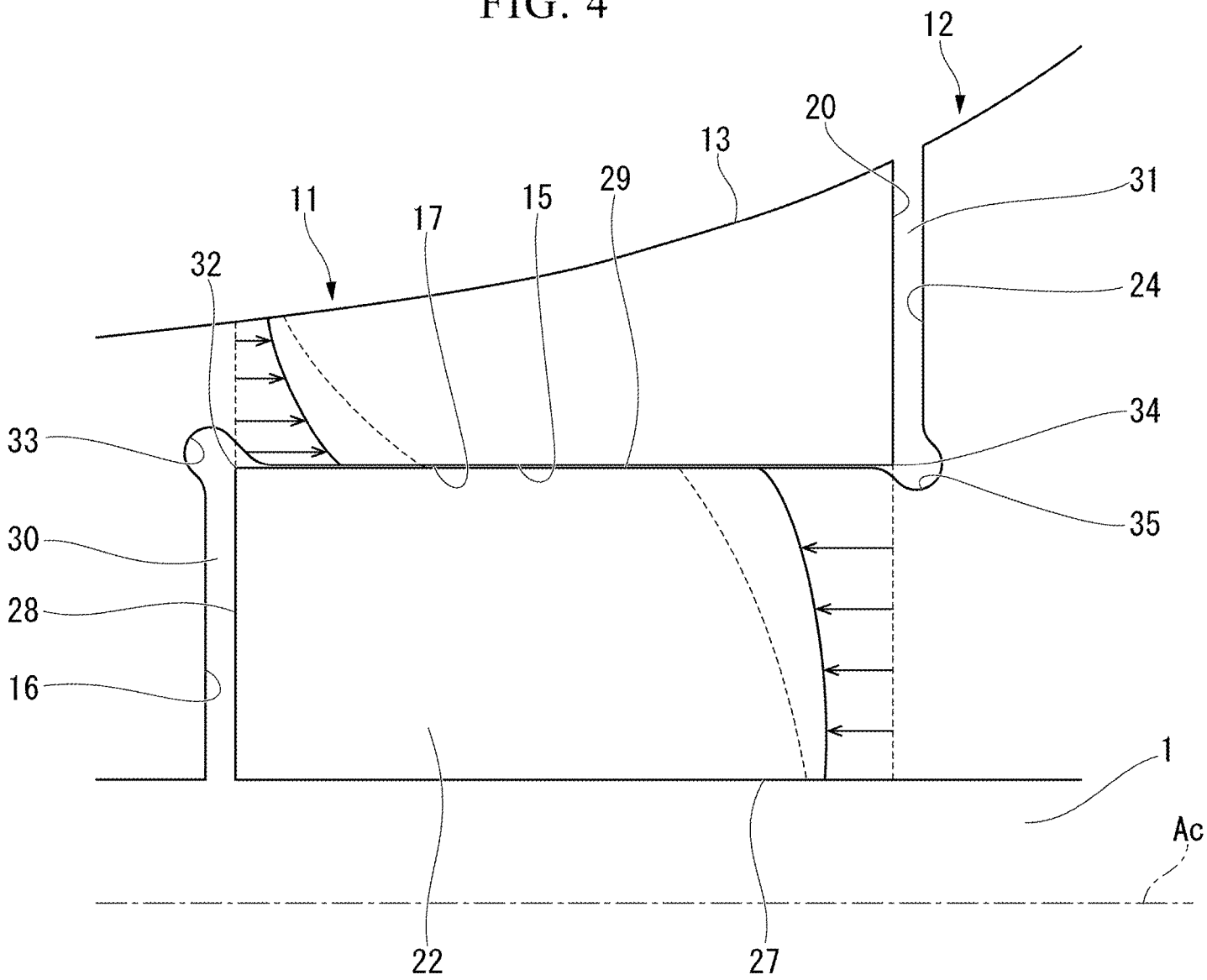
FIG. 4 is an explanatory view illustrating a stress distribution in the impeller according to the first embodiment of the present invention.

Next, the stress distribution at the joined portion between the first disk member 11 and the second disk member 12 will be described with reference to FIG. 4. In FIG. 4, the magnitude of a stress generated in the vicinity of the above-described first angular portion 32 and second angular portion 34 is indicated by the length of arrows, and the magnitude of ae stress distribution in a case where the first groove 33 and the second groove 35 are formed indicated by solid lines. As illustrated in the drawing, in the vicinity of the first angular portion 32, the stress increases from the outside toward the inside in the radial direction. Additionally, in the vicinity of the second angular portion 34, the stress increases from the inside to the outside in the radial direction. In addition, dashed lines indicate stress distributions in a case where the first groove 33 and the second groove 35 are not formed. As illustrated in the drawing, in a case where the first groove 33 and the second groove 35 are formed, both the stresses in the direction of the axis Ac in the vicinity of the first angular portion 32 and the second angular portion 34 are reduced compared to a case where the first groove 33 and the second groove 35 are not formed. In this way, according to the impeller 4 and the rotary machine related to the present embodiment, the stress concentration at the joined portion between the first disk member 11 and the second disk member 12 can be relaxed, and the possibility of fretting fatigue based on this can be reduced. Accordingly, the highly reliable impeller 4 and the centrifugal compressor 100 including the impeller 4 can be provided.

The first embodiment of the present invention has been described above. In addition, various changes and modifications can be made to the above configuration without departing from the spirit of the present invention. For example, in the above-described embodiment, an example has been described in which the first groove 33 and the second groove 35 are formed over the entire region in the circumferential direction. However, the aspect of the first groove 33 and the second groove 35 is not limited to the above, and for example, it is also possible to adopt a configuration in which the first groove 33 and the second groove 35 are discontinuously formed at equal intervals in the circumferential direction.

Second Embodiment

Figure 5:
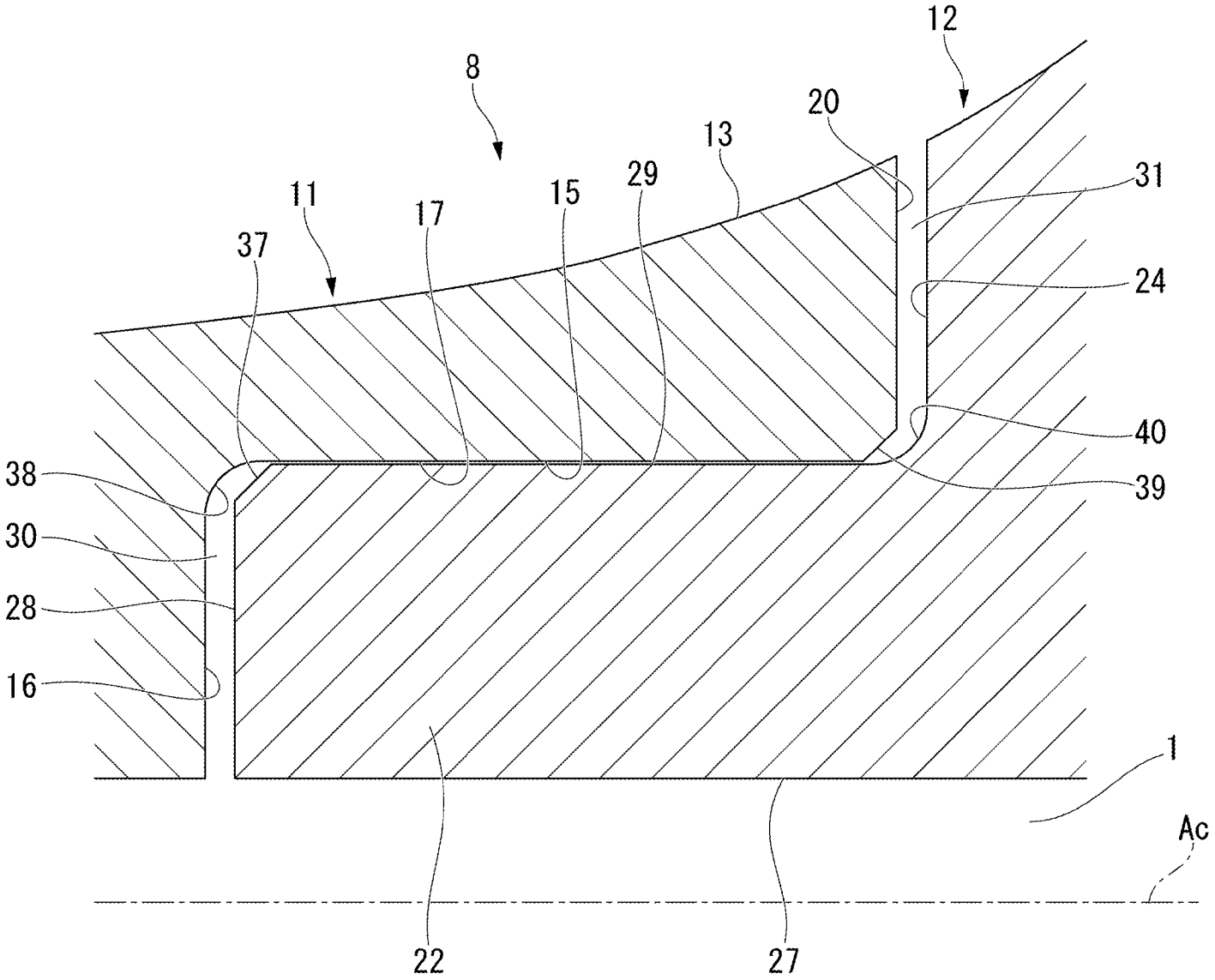
FIG. 5 is an enlarged sectional view of main parts of an impeller according to a second embodiment of the present invention.

Next, a second embodiment of the present invention will be described with reference to FIG. 5. In addition, the same components as those in the first embodiment are denoted by the same reference numerals, and detailed description thereof will be omitted. As illustrated in FIG. 5, in the present embodiment, a first tapered surface 37 is formed between the insertion portion end surface 28 and the insertion portion outer peripheral surface 29. The first tapered surface 37 broadens in a direction intersecting the axis Ac. In the present embodiment, the first tapered surface 37 forms 45° with respect to the axis Ac in a sectional view including the axis Ac. The first tapered surface 37 is continuously formed over the entire region in the circumferential direction with respect to the axis Ac.

A first rounded portion 38 is formed between the recessed portion bottom surface 16 and the recessed portion inner peripheral surface 17. The first rounded portion 38 has a substantially arcuate shape in a sectional view including the axis Ac. Specifically, the first rounded portion 38 gradually curves from the recessed portion bottom surface 16 toward the recessed portion inner peripheral surface 17. The first rounded portion 38 faces the first tapered surface 37 from the direction of the axis Ac. Additionally, a gap is formed between the first rounded portion 38 and the first tapered surface 37, and both do not abut against each other. The second rounded portion 40 is continuously formed over the entire region in the circumferential direction with respect to the axis Ac.

A second tapered surface 39 is formed on the recessed portion inner peripheral surface 17 and the first end surface 20. The second tapered surface 39 broadens in a direction intersecting the axis Ac. In the present embodiment, the second tapered surface 39 forms 45° with respect to the axis Ac in a sectional view including the axis Ac. The second tapered surface 39 is continuously formed over the entire region in the circumferential direction with respect to the axis Ac.

A second rounded portion 40 is formed between the insertion portion outer peripheral surface 29 and the second end surface 24. The second rounded portion 40 has a substantially arcuate shape in a sectional view including the axis Ac. Specifically, the second rounded portion 40 gradually curves from the insertion portion outer peripheral surface 29 toward the second end surface 24. The second rounded portion 40 faces the second tapered portion from the direction of the axis Ac. Additionally, a gap is formed between the second rounded portion 40 and the second tapered surface 39, and both do not abut against each other. The second rounded portion 40 is continuously formed over the entire region in the circumferential direction with respect to the axis Ac.

According to the above-described configuration, the first tapered surface 37 is formed between the insertion portion end surface 28 and the insertion portion outer peripheral surface 29. For that reason, in a case where a centrifugal force or a differential pressure on both sides in the direction of the axis Ac is applied to the disk 8, the stress is released by the first tapered surface 37. Accordingly, the stress generated on the insertion portion end surface 28 can be relaxed as compared to a configuration in which the first tapered surface 37 is not provided. Moreover, the first rounded portion 38 is formed between the recessed portion bottom surface 16 and the recessed portion inner peripheral surface 17. Accordingly, for example, as compared to a case where an angular portion is formed between the recessed portion bottom surface 16 and the recessed portion inner peripheral surface 17, the stress concentration in the portion can be relaxed. Additionally, particularly, by providing the first tapered surface 37, a large curvature radius of the first rounded portion 38 can be secured. Moreover, the second tapered surface 39 is formed between the recessed portion inner peripheral surface 17 and the first end surface 20. For that reason, in a case where a centrifugal force or a differential pressure is applied, the stress is released by the second tapered surface 39. Accordingly, the stress generated on the first end surface 20 can be relaxed as compared to a configuration in which the second tapered surface 39 is not provided. Moreover, the second rounded portion 40 is formed between the insertion portion outer peripheral surface 29 and the second end surface 24. Accordingly, for example, as compared to a case where an angular portion is formed between the insertion portion outer peripheral surface 29 and the second end surface 24, the stress concentration in the portion can be relaxed. Additionally, particularly, by providing the second tapered surface 39, a large curvature radius of the second rounded portion 40 can be secured.

Moreover, according to the above-described configuration, the first tapered surface 37, the second tapered surface 39, the first rounded portion 38, and the second rounded portion 40 are formed over the entire region in the circumferential direction. For that reason, it is possible to release the stress evenly over the entire region in the circumferential direction. In other words, local stress concentration in the circumferential direction can be avoided. In this way, according to the impeller 4 and the rotary machine related to the present embodiment, the stress concentration at the joined portion between the first disk member 11 and the second disk member 12 can be relaxed, and the possibility of fretting fatigue based on this can be reduced. Accordingly, the highly reliable impeller 4 and the centrifugal compressor 100 including the impeller 4 can be provided.

The second embodiment of the present invention has been described above. In addition, various changes and modifications can be made to the above configuration without departing from the spirit of the present invention. For example, in the above-described embodiment, an example has been described in which the first tapered surface 37, the second tapered surface 39, the first rounded portion 38, and the second rounded portion 40 are formed over the entire region in the circumferential direction. However, the aspect of the first tapered surface 37, the second tapered surface 39, the first rounded portion 38, and the second rounded portion 40 are not limited to the above, and it is also possible to adopt, for example, a configuration in which the first tapered surface 37, the second tapered surface 39, the first rounded portion 38, and the second rounded portion 40 are discontinuously formed at equal intervals in the circumferential direction.

Third Embodiment

Figure 6:
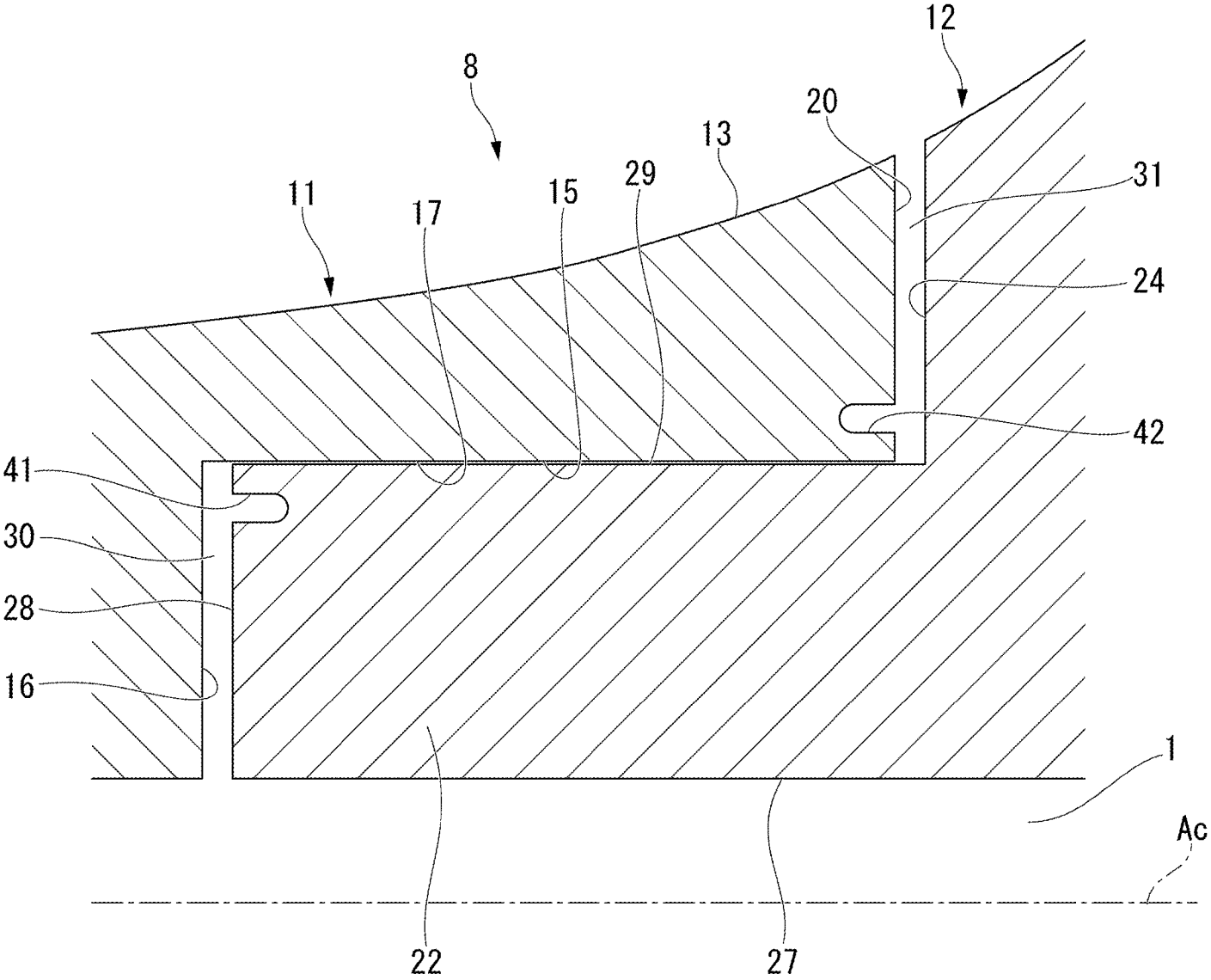
FIG. 6 is an enlarged sectional view of main parts of an impeller according to a third embodiment of the present invention.

Subsequently, a third embodiment of the present invention will be described with reference to FIG. 6. In addition, the same components as those in the respective embodiments are denoted by the same reference numerals, and detailed description thereof will be omitted. As illustrated in FIG. 6, in the present embodiment, a third groove 41 is formed in the insertion portion end surface 28, and a fourth groove 42 is formed in the first end surface 20. The third groove 41 is recessed from the insertion portion end surface 28 toward a first side in the direction of the axis Ac. The third groove 41 is formed at a portion of the insertion portion end surface 28 that is close to a radially outer edge. In other words, the distance between the insertion portion outer peripheral surface 29 and the third groove 41 is smaller than the distance between the insertion portion inner peripheral surface 27 and the third groove 41. Accordingly, in a case where a force is applied from the radial outside, the portion radially outside the third groove 41 is elastically deformed like a spring. In other words, the portion radially outside the third groove 41 has lower rigidity than the other portions. In addition, the third groove 41 is continuously formed over the entire region in the circumferential direction with respect to the axis Ac.

The fourth groove 42 is recessed from the first end surface 20 toward a second side in the direction of the axis Ac. The fourth groove 42 is formed at a portion of the first end surface 20 that is close to a radially inner edge. In other words, the distance between the recessed portion inner peripheral surface 17 and the fourth groove 42 is smaller than the distance between the first disk outer peripheral surface 13 and the fourth groove 42. Accordingly, in a case where a force is applied from the radial outside, the portion radially inside the fourth groove 42 is elastically deformed like a spring. In other words, the portion radially inside the fourth groove 42 has lower rigidity than the other portions. In addition, the fourth groove 42 is continuously formed over the entire region in the circumferential direction with respect to the axis Ac.

According to the above-described configuration, the third groove 41 is formed in the insertion portion end surface 28. For that reason, in a case where a stress is exerted from the direction along the insertion portion end surface 28, the third groove 41 is elastically deformed so as to be crushed from both sides in the radial direction with respect to the axis Ac. That is, the rigidity of the insertion portion end surface 28 is reduced, and the stress can be released. Moreover, the fourth groove 42 is formed in the first end surface 20. For that reason, in a case where a stress is exerted from the direction along the first end surface 20, the fourth groove 42 is elastically deformed so as to be crushed from both sides in the radial direction with respect to the axis Ac. That is, the rigidity of the first end surface 20 is reduced, and the stress can be released.

Moreover, according to the above-described configuration, the third groove 41 and the fourth groove 42 are formed over the entire region in the circumferential direction. For that reason, it is possible to release the stress evenly over the entire region in the circumferential direction. In other words, local stress concentration in the circumferential direction can be avoided.

The third embodiment of the present invention has been described above. In addition, various changes and modifications can be made to the above configuration without departing from the spirit of the present invention. For example, in the above-described embodiment, an example has been described in which the third groove 41 and the fourth groove 42 are respectively formed over the entire region in the circumferential direction. However, the aspect of the third groove 41 and the fourth groove 42 is not limited to the above, and it is possible to adopt, for example, a configuration in which the third groove 41 and the fourth groove 42 are discontinuously formed at equal intervals in the circumferential direction.

Moreover, the third groove 41 and the fourth groove 42 described in the above third embodiment can also be applied in combination with the first groove 33 and the second groove 35 in the above-described first embodiment. Similarly, the third groove 41 and the fourth groove 42 can be applied in combination with the first tapered surface 37, the second tapered surface 39, the first rounded portion 38, and the second rounded portion 40 in the above-described second embodiment. In either configuration, the stress generated at the joined portion between the first disk member 11 and the second disk member 12 can be further relaxed, and the possibility of fretting fatigue can be reduced.

INDUSTRIAL APPLICABILITY

According to the present invention, highly reliable impeller and rotary machine can be provided.

REFERENCE SIGNS LIST

1 rotor
2 journal bearing
3 thrust bearing
4 impeller
5 casing
6 exhaust port
7 suction port
8 disk
9 blade
10 cover
11 first disk member
12 second disk member
13 first disk outer peripheral surface
14 first insertion hole
15 recessed portion
16 recessed portion bottom surface
17 recessed portion inner peripheral surface
18 insertion hole inner peripheral surface
19 fitting portion
20 first end surface
21 second disk member body
22 insertion portion
23 second insertion hole
24 second end surface
25 main surface
26 back surface
27 insertion portion inner peripheral surface
28 insertion portion end surface
29 insertion portion outer peripheral surface
30 first gap
31 second gap
32 first angular portion
33 first groove
34 second angular portion
35 second groove
36 cover inner peripheral surface
37 first tapered surface
38 first rounded portion
39 second tapered surface
40 second rounded portion
41 third groove
42 fourth groove
100 centrifugal compressor
Ac axis
Pc casing flow passage
Fi impeller flow passage

What is claimed is:

1. An impeller comprising:

a disk having a first disk member that has a tubular shape centered on an axis, and a second disk member that has a tubular shape centered on the axis and is arranged on a first side of the first disk member in a direction of the axis;

a blade that is formed integrally with the second disk member; and a cover that forms a flow passage between the cover and the second disk member by covering the blade from an outer peripheral side, wherein a recessed portion, which is recessed from the first side toward a second side in the direction of the axis, is formed in an annular-shape around the axis in the first disk member, wherein the second disk member has a second disk member body formed in a disk-shape around the axis, and an insertion portion that protrudes from the second disk member body toward the second side in the direction of the axis around the axis and is inserted into the recessed portion, wherein a first groove, which surrounds, from the outside, a first angular portion formed by an insertion portion end surface of the insertion portion facing the second side in the direction of the axis and an insertion portion outer peripheral surface of the insertion portion facing radially outward with respect to the axis, recedes toward the second side in the direction of the axis from a recessed portion bottom surface, and recedes radially outward with respect to the axis from a recessed portion inner peripheral surface, is formed at a connection portion between the recessed portion bottom surface facing the first side in the direction of the axis and the recessed portion inner peripheral surface facing radially inward with respect to the direction of the axis in the recessed portion, wherein a second groove, which surrounds, from the outside, a second angular portion formed by the recessed portion inner peripheral surface and a first end surface of the first disk member facing the first side in the direction of the axis, recedes radially inward with respect to the axis from the insertion portion outer peripheral surface, and recedes toward the first side in the direction of the axis from a second end surface is formed at a connection portion between the insertion portion outer peripheral surface and the second end surface of the second disk member body facing the second side in the direction of the axis, wherein a third groove, which is recessed from the insertion portion end surface toward the first side in the direction of the axis, is formed in the insertion portion end surface, and wherein a fourth groove, which is recessed from the first end surface toward the second side in the direction of the axis, is formed in the first end surface.

2. The impeller according to claim 1, wherein the first groove and the second groove are formed over an entire region in a circumferential direction with respect to the axis.

3. An impeller comprising:

a disk having a first disk member that has a tubular shape centered on an axis, and a second disk member that has a tubular shape centered on the axis and is arranged on a first side with respect to the first disk member in a direction of the axis;

a blade that is formed integrally with the second disk member; and a cover that forms a flow passage between the cover and the second disk member by covering the blade from an outer peripheral side, wherein a recessed portion, which is recessed from the first side toward a second side in the direction of the axis, is formed in an annular-shape around the axis in the first disk member, wherein the second disk member has a second disk member body formed in a disk-shape around the axis, and an insertion portion that protrudes from the second disk member body toward the second side in the direction of the axis around the axis and is inserted into the recessed portion, wherein a first tapered surface broadening in a direction intersecting the axis is formed between an insertion portion end surface of the insertion portion facing the second side in the direction of the axis and an insertion portion outer peripheral surface of the insertion portion facing radially outward with respect to the axis, wherein a first rounded portion, which gradually curves from a recessed portion bottom surface toward a recessed portion inner peripheral surface, is formed between the recessed portion bottom surface facing the first side in the direction of the axis and the recessed portion inner peripheral surface facing radially inward with respect to the direction of the axis in the recessed portion, wherein a second tapered surface, which broadens in a direction intersecting the axis, is formed between the recessed portion inner peripheral surface and a first end surface of the first disk member facing the first side in the direction of the axis, wherein a second rounded portion, which gradually curves from the insertion portion outer peripheral surface toward a second end surface, is formed between the insertion portion outer peripheral surface and the second end surface of the second disk member body facing the second side in the direction of the axis, wherein a third groove, which is recessed from the insertion portion end surface toward the first side in the direction of the axis, is formed in the insertion portion end surface, and wherein a fourth groove, which is recessed from the first end surface toward the second side in the direction of the axis, is formed in the first end surface.

4. The impeller according to claim 3, wherein the first tapered surface, the second tapered surface, the first rounded portion, and the second rounded portion are formed over an entire region in a circumferential direction with respect to the axis.

5. An impeller comprising:

a disk having a first disk member that has a tubular shape centered on an axis, and a second disk member that has a tubular shape centered on the axis and is arranged on a first side of the first disk member in a direction of the axis;

a blade that is formed integrally with the second disk member; and a cover that forms a flow passage between the cover and the second disk member by covering the blade from an outer peripheral side, wherein a recessed portion, which is recessed from the first side toward a second side in the direction of the axis, is formed in an annular-shape around the axis in the first disk member, wherein the second disk member has a second disk member body formed in a disk-shape around the axis, and an insertion portion that protrudes from the second disk member body toward the second side in the direction of the axis around the axis and is inserted into the recessed portion, wherein a third groove, which is recessed from an insertion portion end surface toward the first side in the axial direction, is formed in the insertion portion end surface of the insertion portion facing the second side in the direction of the axis, and wherein a fourth groove, which is recessed from a first end surface toward the second side in the direction of the axis, is formed in the first end surface of the first disk member facing the first side in the direction of the axis.

6. The impeller according to claim 5, wherein the third groove and the fourth groove are formed over an entire region in a circumferential direction with respect to the axis.

7. A rotary machine comprising:

an impeller according to claim 1, and a casing that covers the impeller from an outer peripheral side.

* * * * *